US011509987B2

(12) United States Patent
Dickins et al.

(10) Patent No.: US 11,509,987 B2
(45) Date of Patent: Nov. 22, 2022

(54) DYNAMIC ENVIRONMENTAL OVERLAY INSTABILITY DETECTION AND SUPPRESSION IN MEDIA-COMPENSATED PASS-THROUGH DEVICES

(71) Applicant: Dolby Laboratories Licensing Corporation, San Francisco, CA (US)

(72) Inventors: Glenn N. Dickins, Como (AU); Joshua Brandon Lando, Mill Valley, CA (US); Andy Jaspar, Walnut Creek, CA (US); C. Phillip Brown, Castro Valley, CA (US); Phillip Williams, Santa Cruz, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 63 days.

(21) Appl. No.: 17/273,915

(22) PCT Filed: Sep. 9, 2019

(86) PCT No.: PCT/US2019/050241
§ 371 (c)(1),
(2) Date: Mar. 5, 2021

(87) PCT Pub. No.: WO2020/051593
PCT Pub. Date: Mar. 12, 2020

(65) Prior Publication Data

US 2021/0337299 A1 Oct. 28, 2021

Related U.S. Application Data

(60) Provisional application No. 62/855,800, filed on May 31, 2019, provisional application No. 62/728,284, filed on Sep. 7, 2018.

(51) Int. Cl.
*H04R 3/02* (2006.01)
*H04R 1/10* (2006.01)

(52) U.S. Cl.
CPC ..... *H04R 1/1041* (2013.01); *H04R 1/1083* (2013.01); *H04R 3/02* (2013.01); *H04R 2430/01* (2013.01)

(58) Field of Classification Search
CPC ..... H04R 1/1041; H04R 1/1083; H04R 3/02; H04R 2430/01
(Continued)

(56) References Cited

U.S. PATENT DOCUMENTS 4,165,445 A * 8/1979 Brosow ..... H04R 3/02 381/83
6,570,985 B1 5/2003 Romesburg
(Continued)

FOREIGN PATENT DOCUMENTS

CN 1867204 B 2/2012
CN 102422346 4/2012
(Continued)

OTHER PUBLICATIONS

Chi, Hsiang-Feng et al "Band-Limited Feedback Cancellation with a Modified Filtered-X LMS Algorithm for Hearing Aids" Association for Computing Machinery, Speech Communication,pp. 146-161, 2003.
(Continued)

*Primary Examiner* — Vivian C Chin
*Assistant Examiner* — Friedrich Fahnert

(57) ABSTRACT

An audio processing method may involve receiving media input audio data corresponding to a media stream and headphone microphone input audio data, determining a media audio gain for at least one of a plurality of frequency bands of the media input audio data and determining a headphone microphone audio gain for at least one of a plurality of frequency bands of the headphone microphone input audio data. Determining the headphone microphone
(Continued)

audio gain may involve determining a feedback risk control value, for at least one of the plurality of frequency bands, corresponding to a risk of headphone feedback between at least one external microphone of a headphone microphone system and at least one headphone speaker and determining a headphone microphone audio gain that will mitigate actual or potential headphone feedback in at least one of the plurality of frequency bands, based at least partly upon the feedback risk control value.

25 Claims, 9 Drawing Sheets

(58) Field of Classification Search
USPC ..... 381/71.6
See application file for complete search history.

(56) References Cited

U.S. PATENT DOCUMENTS

| | | | | |
|---|---|---|---|---|
| 7,965,853 | B2 | 6/2011 | Gao | |
| 8,428,274 | B2 | 4/2013 | Shiraishi | |
| 8,477,976 | B2 | 7/2013 | Sheikh | |
| 8,611,553 | B2 | 12/2013 | Bakalos | |
| 8,824,695 | B2 | 9/2014 | Bakalos | |
| 8,923,540 | B2 | 12/2014 | Boldt | |
| 9,165,549 | B2 | 10/2015 | Van Leest | |
| 2007/0280487 | A1 | 12/2007 | Ura | |
| 2010/0020995 | A1 | 1/2010 | Elmedyb | |
| 2012/0201396 | A1 | 8/2012 | Schmidt | |
| 2016/0100259 | A1 | 4/2016 | Guo | |
| 2017/0180878 | A1 | 6/2017 | Petersen | |
| 2018/0063654 | A1* | 3/2018 | Kuriger | H04M 9/082 |
| 2018/0150276 | A1 | 5/2018 | Vacek | |
| 2019/0179604 | A1* | 6/2019 | Alexander | H04R 3/04 |
| 2019/0379972 | A1* | 12/2019 | Peso Parada | H04R 3/02 |

FOREIGN PATENT DOCUMENTS

| | | | |
|---|---|---|---|
| EP | 2849462 | | 3/2015 |
| EP | 3062531 | | 8/2016 |
| EP | 3291581 | | 3/2018 |
| WO | 03103163 | | 12/2003 |
| WO | 2009138754 | A1 | 11/2009 |
| WO | 2011159349 | | 12/2011 |
| WO | 2012114155 | A1 | 8/2012 |
| WO | 2017218621 | | 12/2017 |

OTHER PUBLICATIONS

Favrot, A. et al. "Complementary N-Band IIR Filterbank Based on 2-Band Complementary Filters" 12th International Workshop on Acoustic Signal Enhancement (Tel-Aviv-Jaffar 2010).

* cited by examiner

DYNAMIC ENVIRONMENTAL OVERLAY INSTABILITY DETECTION AND SUPPRESSION IN MEDIA-COMPENSATED PASS-THROUGH DEVICES

CROSS REFERENCE TO RELATED APPLICATIONS

This application claims priority of U.S. Provisional Application No. 62/855,800, filed May 31, 2019, and U.S. Provisional Application No. 62/728,284, filed Sep. 7, 2018, both of which are hereby incorporated by reference in their entireties.

TECHNICAL FIELD

This disclosure relates to processing audio data. In particular, this disclosure relates to processing media input audio data corresponding to a media stream and microphone input audio data from at least one microphone.

BACKGROUND

The use of audio devices such as headphones and earbuds has become extremely common. Such audio devices can at least partially occlude sounds from the outside world. Some headphones are capable of creating a substantially closed system between headphone speakers and the eardrum, in which sounds from the outside world are greatly attenuated. There are various potential advantages of attenuating sounds from the outside world via headphones or other such audio devices, such as eliminating distortion, providing a flat equalization, etc. However, when wearing such audio devices a user may not be able to hear sounds from the outside world that it would be advantageous to hear, such as the sound of an approaching car, the sound of a friend's voice, etc.

SUMMARY

As used herein, the term "headphone" or "headphones" refers to an ear device having at least one speaker configured to be positioned near the ear, the speaker being mounted on a physical form (referred to herein as a "headphone unit") that at least partially blocks the acoustic path from sounds occurring around the user wearing the headphones. Some headphone units may be earcups that are configured to significantly attenuate sound from the outside world. Such sounds may be referred to herein as "environmental" sounds. A "headphone" as used herein may or may not include a headband or other physical connection between the headphone units. A media-compensated pass-through (MCP) headphone may include at least one headphone microphone on the exterior of the headphone. Such headphone microphones also may be referred to herein as "environmental" microphones because the signals from such microphones can provide environmental sounds to a user even if the headphone units significantly attenuate environmental sound when worn. An MCP headphone may be configured to process both the microphone and media signals such that when mixed, the environmental microphone signal is audible above the media signal.

Determining appropriate gains for the environmental microphone signals and the media signals of MCP headphones can be challenging. Both the environmental microphone signals and the media signals may change their signal levels and frequency content, sometimes rapidly. Rapid changes in the signal level and/or frequency content of the environmental microphone signals can lead to "environmental overlay instability," such as feedback between an external microphone and a headphone speaker.

Some disclosed implementations are designed to mitigate environmental overlay instability. In some implementations, an apparatus disclosed herein may include an interface system, a headphone microphone system that includes at least one headphone microphone, a headphone speaker system that includes at least one headphone speaker, and a control system. The control system may be configured for receiving, via the interface system, media input audio data corresponding to a media stream and receiving headphone microphone input audio data from the headphone microphone system. The control system may be configured for determining a media audio gain for at least one of a plurality of frequency bands of the media input audio data and for determining a headphone microphone audio gain for at least one of a plurality of frequency bands of the headphone microphone input audio data.

Determining the headphone microphone audio gain may involve determining a feedback risk control value, for at least one of the plurality of frequency bands, corresponding to a risk of headphone feedback between at least one external microphone of a headphone microphone system and at least one headphone speaker. Determining the headphone microphone audio gain also may involve determining a headphone microphone audio gain that will mitigate actual or potential headphone feedback in at least one of the plurality of frequency bands, based at least partly upon the feedback risk control value.

The control system may be configured for producing media output audio data by applying the media audio gain to the media input audio data in at least one of the plurality of frequency bands. The control system may be configured for mixing the media output audio data and the headphone microphone output audio data to produce mixed audio data and for providing the mixed audio data to the headphone speaker system.

Some disclosed implementations have potential advantages. In some examples, the control system may be configured to detect an increased feedback risk and may cause the maximum headphone microphone signal gain to be reduced. In some implementations, environmental overlay instability may generally occur in one or more specific frequency bands. The frequency band(s) will depend on the particular design. If the control system determines that the audio level in one or more of the frequency band(s) is starting to ramp up, the control system may determine that this condition is an indication of feedback risk. Some implementations may involve determining the feedback risk control value based, at least in part, on a detected indication that the headphones are being removed from a user's head, or may soon be removed from the user's head.

Details of one or more implementations of the subject matter described in this specification are set forth in the accompanying drawings and the description below. Other features, aspects, and advantages will become apparent from the description, the drawings, and the claims. Note that the relative dimensions of the following figures may not be drawn to scale.

BRIEF DESCRIPTION OF THE DRAWINGS

Like reference numbers and designations in the various drawings indicate like elements.

DESCRIPTION OF EXAMPLE EMBODIMENTS

Figure 1:
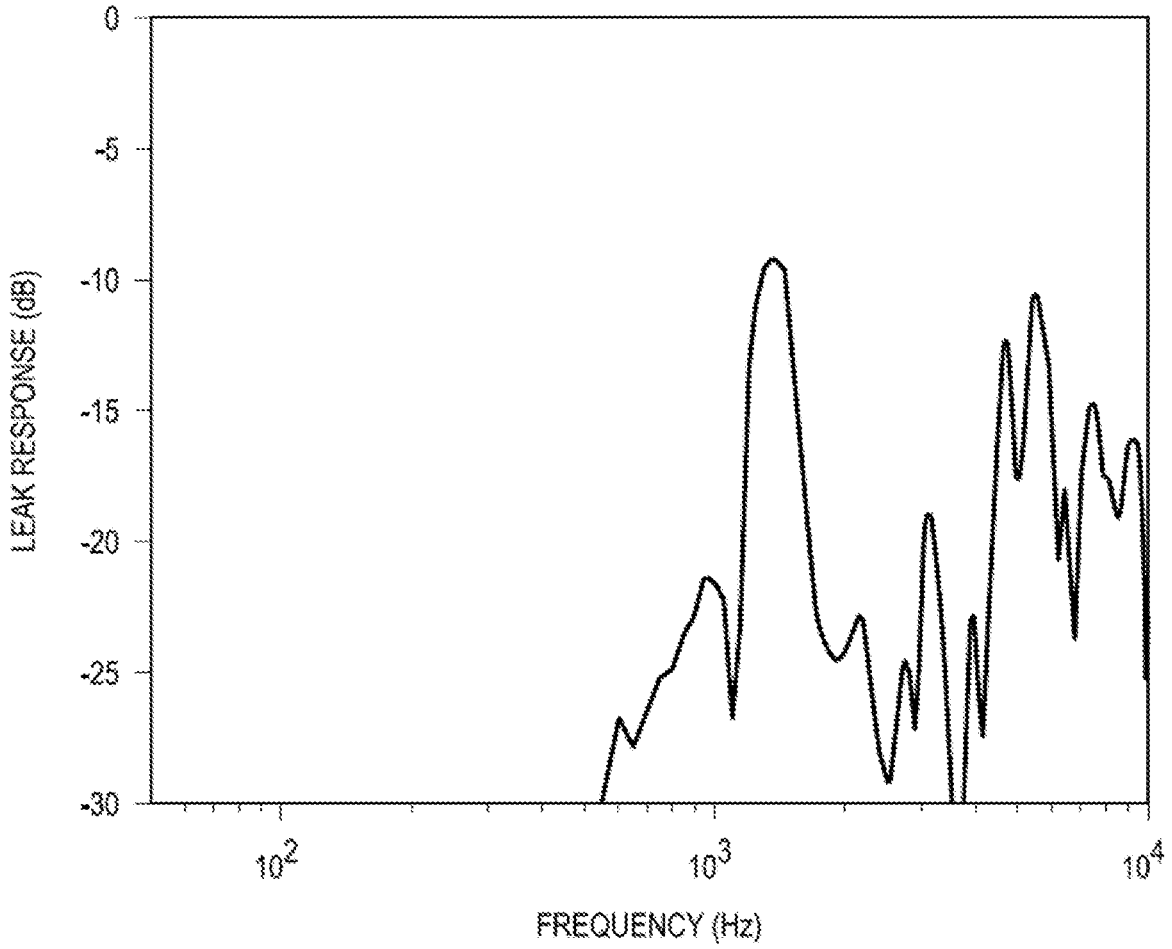
FIG. 1 is a graph that shows an example of the leak response from a headphone driver to an environmental microphone.

The following description is directed to certain implementations for the purposes of describing some innovative aspects of this disclosure, as well as examples of contexts in which these innovative aspects may be implemented. However, the teachings herein can be applied in various different ways. For example, while various implementations are described in terms of particular applications and environments, the teachings herein are widely applicable to other known applications and environments. Moreover, the described implementations may be implemented, at least in part, in various devices and systems as hardware, software, firmware, cloud-based systems, etc. Accordingly, the teachings of this disclosure are not intended to be limited to the implementations shown in the figures and/or described herein, but instead have wide applicability.

As noted above, audio devices that provide at least some degree of sound occlusion provide various potential benefits, such an improved ability to control audio quality. Other benefits include attenuation of potentially annoying or distracting sounds from the outside world. However, a user of such audio devices may not be able to hear sounds from the outside world that it would be advantageous to hear, such as the sound of an approaching car, a car horn, a public announcement, etc.

Accordingly, one or more types of sound occlusion management would be desirable. Various implementations described herein involve sound occlusion management during times that a user is listening to a media stream of audio data via headphones, earbuds, or another such audio device. As used herein, the terms "media stream," "media signal" and "media input audio data" may be used to refer to audio data corresponding to music, a podcast, a movie soundtrack, etc., as well as the audio data corresponding to sounds received for playback as part of a telephone conversation. In some implementations, such as earbud implementations, the user may be able to hear a significant amount of sound from the outside world even while listening to audio data corresponding to a media stream. However, some audio devices (such as headphones) can significantly attenuate sound from the outside world. Accordingly, some implementations may also involve providing microphone data to a user. The microphone data may provide sounds from the outside world.

When a microphone signal corresponding to sound external to an audio device, such as a headphone, is mixed with the media signal and played back through speakers of the headphone, the media signal often masks the microphone signal, making the external sound inaudible or unintelligible to the listener. As such, it is desirable to process both the microphone and media signal such that when mixed, the microphone signal is audible above the media signal, and both the processed microphone and media signal remain perceptually natural-sounding. In order to achieve this effect, it is useful to consider a model of perceptual loudness and partial loudness, such as disclosed in International Publication No. WO 2017/217621, entitled "Media-Compensated Pass-Through and Mode-Switching," which is hereby incorporated by reference.

Some methods may involve determining a first level of at least one of a plurality of frequency bands of the media input audio data and determining a second level of at least one of a plurality of frequency bands of the microphone input audio data. Some such methods may involve producing media output audio data and microphone output audio data by adjusting levels of one or more of the first and second plurality of frequency bands. For example, some methods may involve adjusting levels such that a first difference between a perceived loudness of the microphone input audio data and a perceived loudness of the microphone output audio data in the presence of the media output audio data is less than a second difference between the perceived loudness of the microphone input audio data and a perceived loudness of the microphone input audio data in the presence of the media input audio data. Some such methods may involve mixing the media output audio data and the microphone output audio data to produce mixed audio data. Some such examples may involve providing the mixed audio data to speakers of an audio device, such as a headset or earbuds.

In some implementations, the adjusting may involve only boosting the levels of one or more of the plurality of frequency bands of the microphone input audio data. However, in some examples the adjusting may involve both boosting the levels of one or more of the plurality of frequency bands of the microphone input audio data and attenuating the levels of one or more of the plurality of frequency bands of the media input audio data. The perceived loudness of the microphone output audio data in the presence of the media output audio data may, in some examples, be substantially equal to the perceived loudness of the microphone input audio data. According to some examples, the total loudness of the media and microphone output audio data may be in a range between the total loudness of the media and microphone input audio data and the total loudness of the media and microphone output audio data. However, in some instances, the total loudness of the media and microphone output audio data may be substantially equal to the total loudness of the media and microphone input audio data, or may be substantially equal to the total loudness of the media and microphone output audio data.

Some implementations may involve receiving (or determining) a mode-switching indication and modifying one or more process based, at least in part, on the mode-switching indication. For example, some implementations may involve modifying at least one of the receiving, determining, producing or mixing process based, at least in part, on the mode-switching indication. In some instances, the modifying may involve increasing a relative loudness of the microphone output audio data, relative to a loudness of the media output audio data. According to some such examples, increasing the relative loudness of the microphone output audio data may involve suppressing the media input audio data or pausing the media stream. Some such implementations provide one or more types of pass-through mode. In a pass-through mode, a media signal may be reduced in volume, and the conversation between the user and other people (or other external sounds of interest to the user, as indicated by the microphone signal) may be mixed into the audio signal provided to a user. In some examples, the media signal may be temporarily silenced.

The above-described methods, along with the other related methods disclosed in International Publication No. WO 2017/217621, may be referred to herein as MCP (media-compensated pass-through) methods. As noted above, some MCP methods involve taking audio from microphones that are disposed on or near the outside of the headphones (which may be referred to herein as environmental microphones or MCP microphones), potentially boosting the signal from the environmental microphones, and playing the environmental microphone signals back via headphone speakers. In some implementations, the headphone design and physical form factor leads to some amount of the signal that is played back through the headphone speakers being picked up by the environmental microphones. This phenomenon may be referred to herein as a "leak" or an "echo." The amount of leakage can vary and will generally become worse as the headphones are removed or when objects are near the environmental microphones (a phenomenon that may be referred to herein as "cupping"). If the combined loop gain of the current leak path and the instantaneous gain of any processing in the MCP loop exceeds unity, there will be environmental overlay instability.

FIG. 1 is a graph that shows an example of the leak response from a headphone driver to an environmental microphone. In FIG. 1, the horizontal axis represents a logarithmic scale of the audio frequency and the vertical axis represents the leak response in decibels. As noted in FIG. 1, the leak response can be very dependent on frequency, with variations of more than 20 decibels over a relatively small frequency range and a steep drop-off of the leak response below 600 Hz.

Figure 2A:
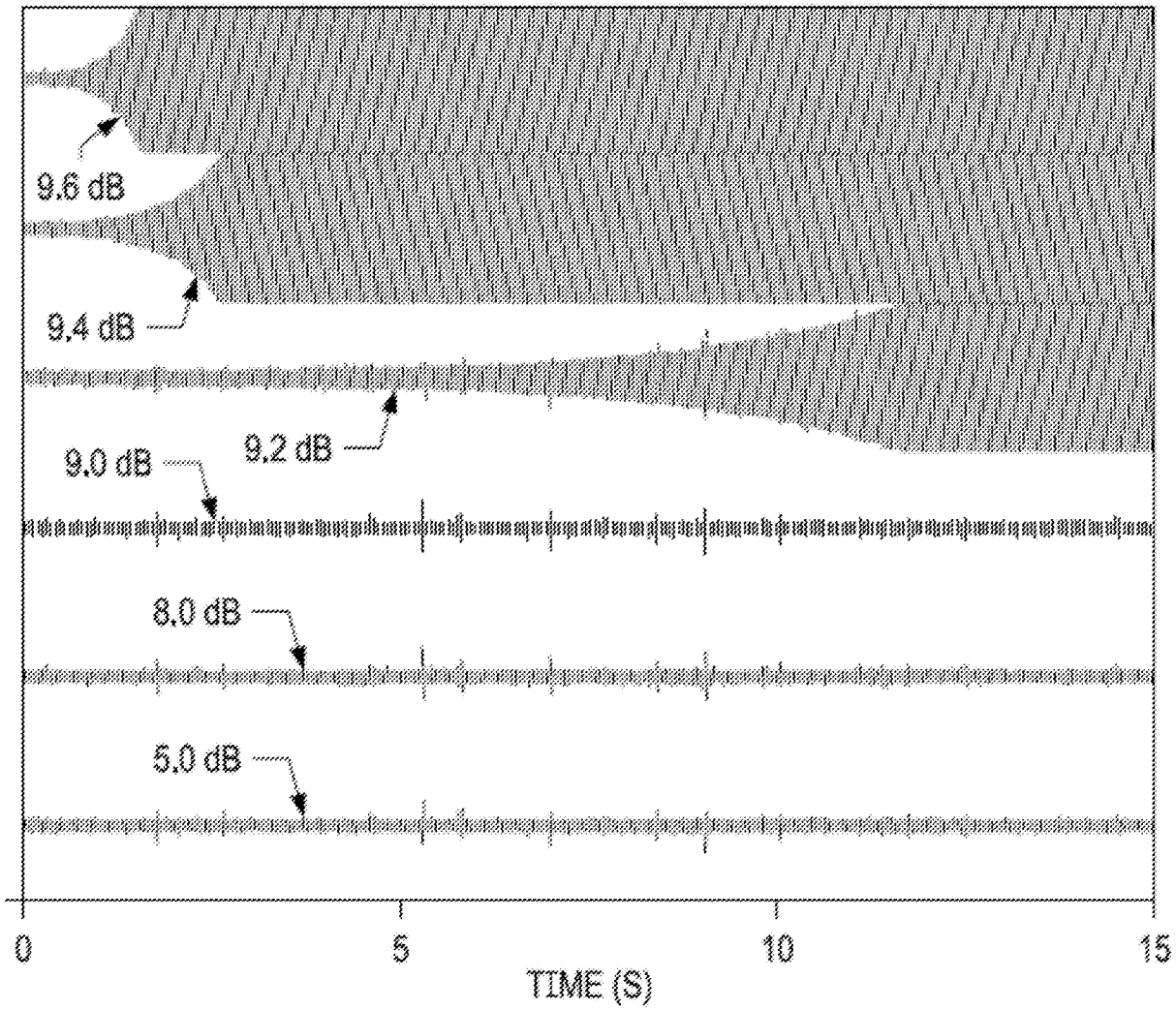
FIG. 2A shows examples of media-compensated pass-through (MCP) headphone responses when the signal from the MCP microphone is boosted and then fed back into the headphone speaker driver.
Figure 2B:
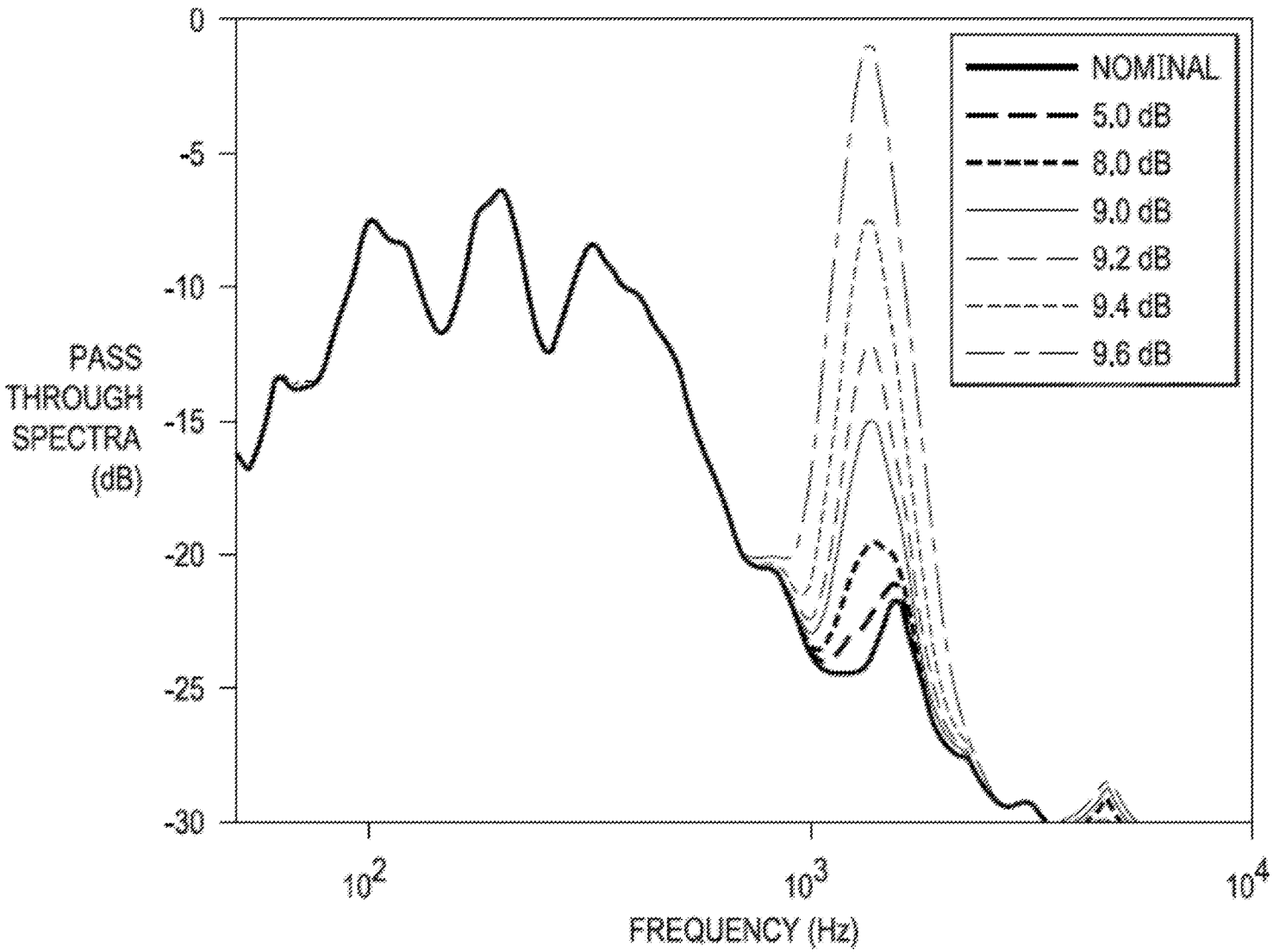
FIG. 2B shows the frequency responses for each of the examples shown in FIG. 2A.

FIG. 2A shows examples of MCP headphone responses when the signal from the MCP microphone is boosted and then fed back into the headphone speaker driver. In these examples, the environmental microphone signals were boosted at least 5.0 dB and as much as 9.6 dB. Time is shown on the horizontal axis and amplitude is shown on the vertical axes. FIG. 2B shows the frequency responses for each of the examples shown in FIG. 2A.

A few conclusions can be made based on the examples shown in FIGS. 1, 2A and 2B. One can see that the transition from intrinsically stable (as shown by the 5.0, 8.0 and 9.0 dB gain examples) to catastrophic (as shown by the 9.2 dB gain example) occurs across less than 2 dB. One can also see that the environmental overlay instability occurs at the maximum of the leak response curve shown in FIG. 1. This may be referred to as the "environmental overlay instability frequency." In some implementations, there may be more than one potential environmental overlay instability frequency. There is very little margin of error: environmental overlay instability is almost certain as soon as the full loop response peak crosses 0 dB.

In these examples, there does not need to be any media signal or excessive signal at the environmental overlay instability frequency inside or outside of the phones. The environmental overlay instability is a manifestation of the loop gain.

In the examples shown in FIGS. 2A and 2B the gain is fixed, so the tone grows exponentially. As noted above, according to some MCP methods during normal operation of MCP headphones the overall signal gain is dependent on both the media signals and the signals corresponding to external sounds that are received from the environmental microphones. The loop gain may be increased as media is played. If this gain is too high, an environmental overlay instability may begin. However, as the external environmental microphone signals increase, some MCP methods will reduce the external environmental microphone signal gain if the external sounds can be heard above the media. Thus, rather than growing exponentially, environmental overlay instability may (at least in some instances) tend to be stable at a level that ensures external sounds are audible above the media.

Figure 3:
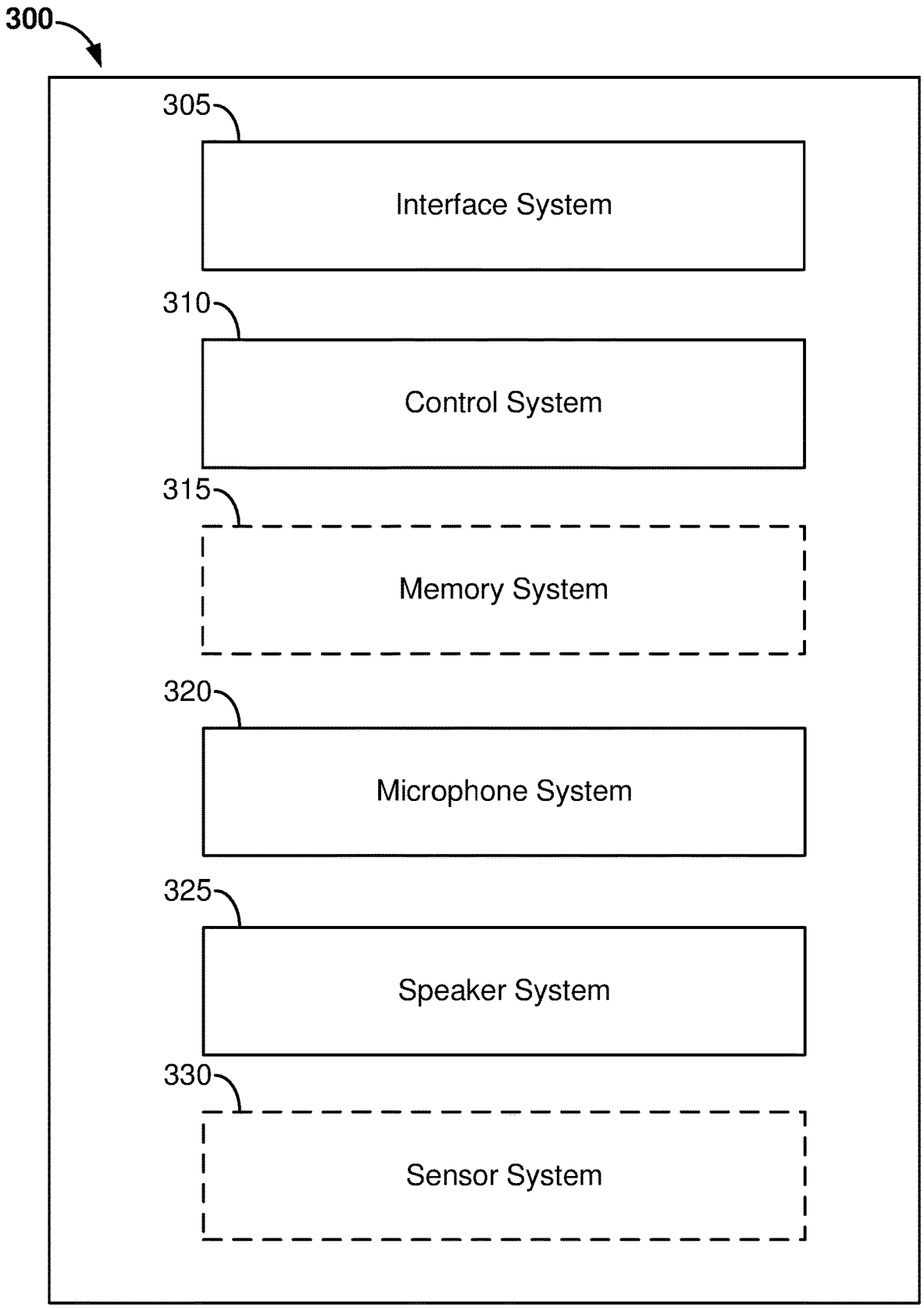
FIG. 3 is a block diagram that shows examples of components of an apparatus capable of implementing various aspects of this disclosure.

FIG. 3 is a block diagram that shows examples of components of an apparatus capable of implementing various aspects of this disclosure. In some implementations, the apparatus 300 may be, or may include, a pair of headphone units. In this example, the apparatus 300 includes an interface system 305 and a control system 310. The interface system 305 may include one or more network interfaces and/or one or more external device interfaces (such as one or more universal serial bus (USB) interfaces). In some examples, the interface system 305 may include one or more interfaces between the control system 310 and a memory system, such as the optional memory system 315 shown in FIG. 3. However, the control system 310 may include a memory system.

The control system 310 may, for example, include a general purpose single- or multi-chip processor, a digital signal processor (DSP), an application specific integrated circuit (ASIC), a field programmable gate array (FPGA) or other programmable logic device, discrete gate or transistor logic, and/or discrete hardware components. In some implementations, the control system 310 may be capable of performing, at least in part, the methods disclosed herein.

Some or all of the methods described herein may be performed by one or more devices according to instructions (e.g., software) stored on non-transitory media. Such non-transitory media may include memory devices such as those described herein, including but not limited to random access memory (RAM) devices, read-only memory (ROM) devices, etc. The non-transitory media may, for example, reside in the optional memory system 315 shown in FIG. 3 and/or in the control system 310. Accordingly, various innovative aspects of the subject matter described in this disclosure can be implemented in a non-transitory medium having software stored thereon. The software may, for example, include instructions for controlling at least one device to process audio data. The software may, for example, be executable by one or more components of a control system such as the control system 310 of FIG. 3.

In this example, the apparatus 300 includes a microphone system 320. The microphone system 320, in this example, includes one or more microphones that reside on, or proximate to, an exterior portion of the apparatus 300, such as on the exterior portion of one or more headphone units.

According to this implementation, the apparatus 300 includes a speaker system 325 having one or more speakers.

In some examples, at least a portion of the speaker system 325 may reside in or on a pair of headphone units.

In this example, the apparatus 300 includes an optional sensor system 330 having one or more sensors. The sensor system 330 may, for example, include one or more accelerometers or gyroscopes. Although the sensor system 330 and the interface system 305 are shown as separate elements in FIG. 3, in some implementations the interface system 305 may include a user interface system that incorporates at least a portion of the sensor system 300. For example, the user interface system may include one or more touch and/or gesture detection sensor systems, one or more inertial sensor devices, etc. The user interface system may be configured for receiving input from a user. In some implementations, the user interface system may be configured for providing feedback to a user. According to some examples, the user interface system may include apparatus for providing haptic feedback, such as a motor, a vibrator, etc.

In some implementations the microphone system 320, the speaker system 325 and/or the sensor system 330 and at least part of the control system 310 may reside in different devices. For example, at least a portion of the control system 310 may reside in a device that is configured for communication with the apparatus 300, such as a smart phone, a component of a home entertainment system, etc.

Figure 4:
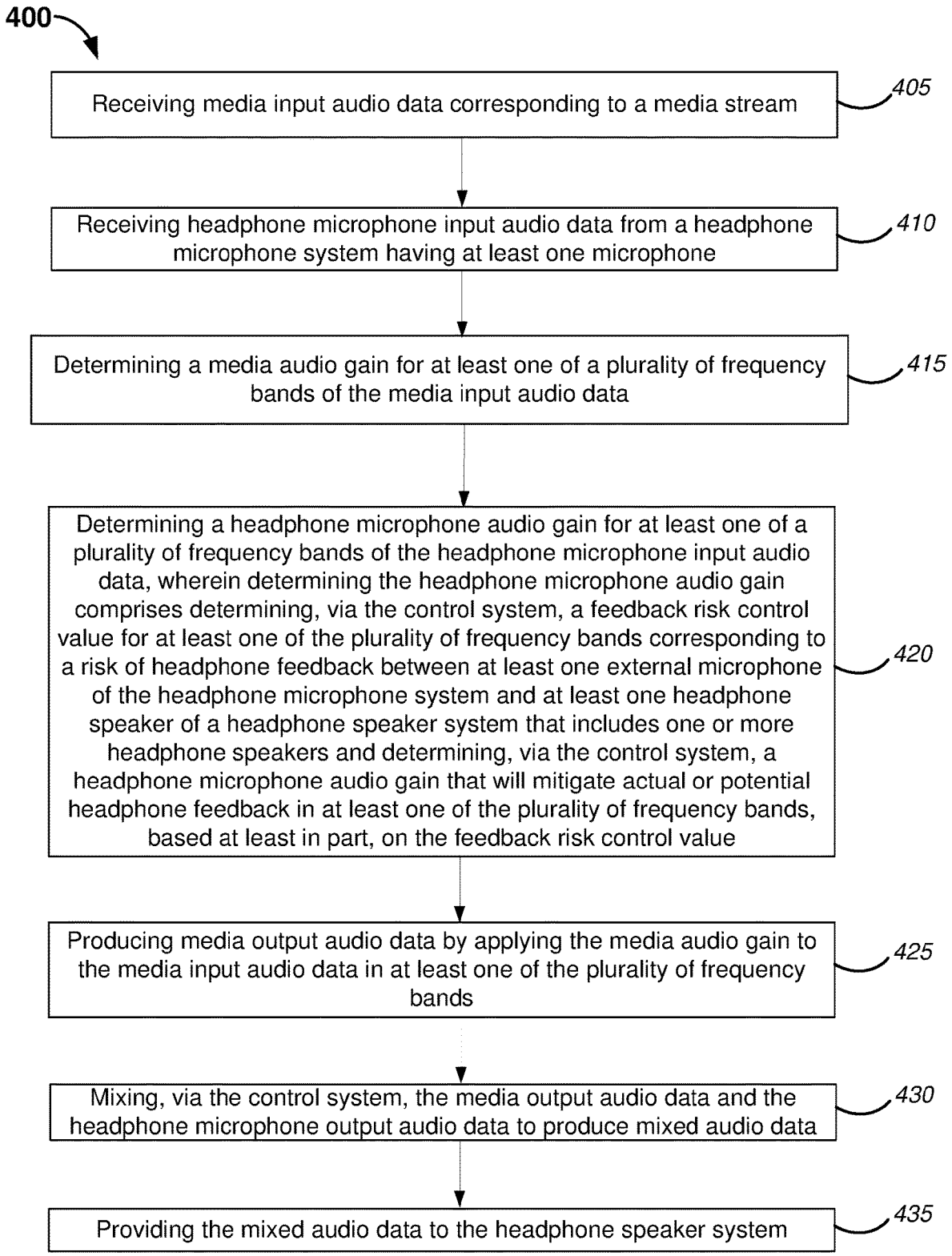
FIG. 4 is a flow diagram that outlines one example of a method that may be performed by an apparatus such as that shown in FIG. 3.

FIG. 4 is a flow diagram that outlines one example of a method that may be performed by an apparatus such as that shown in FIG. 3. The blocks of method 400, like other methods described herein, are not necessarily performed in the order indicated. Moreover, such methods may include more or fewer blocks than shown and/or described.

In this example, block 405 involves receiving media input audio data corresponding to a media stream. Block 405 may, for example, involve a control system (such as the control system 310 of FIG. 3) receiving the media input audio data via an interface system (such as the interface system 305 of FIG. 3).

According to this example, block 410 involves receiving (e.g., via the interface system) headphone microphone input audio data from a headphone microphone system. In some examples, the headphone microphone system may be the headphone microphone system 320 that is described above with reference to FIG. 3. In this example, the headphone microphone system includes at least one headphone microphone. According to this example, the headphone microphone(s) include at least one external headphone microphone.

In this implementation, block 415 involves determining (e.g., by a control system) a media audio gain for at least one of a plurality of frequency bands of the media input audio data. In some such examples, block 415 (or another part of method 400) may involve transforming media input audio data from the time domain to a frequency domain. Method 400 also may involve applying a filterbank that breaks the media input signals into discrete frequency bands.

According to this example, block 420 involves determining (e.g., by a control system) a headphone microphone audio gain for at least one of a plurality of frequency bands of the headphone microphone input audio data. Accordingly, method 400 may involve transforming headphone microphone input signals from the time domain to a frequency domain and applying a filterbank that breaks the headphone microphone signals into frequency bands. In some examples, blocks 415 and 420 may involve applying MCP methods such as those disclosed in International Publication No. WO 2017/217621, entitled "Media-Compensated Pass-Through and Mode-Switching."

According to this example, block 420 involves determining a feedback risk control value for at least one of the plurality of frequency bands. In this example, feedback risk control value corresponds to a risk of environmental overlay instability and specifically corresponds to a risk of headphone feedback between at least one external microphone of the headphone microphone system and at least one headphone speaker of a headphone speaker system. The headphone speaker system may include one or more headphone speakers disposed in one or more headphone units.

In this example, block 420 involves determining a headphone microphone audio gain that will mitigate actual or potential headphone feedback in at least one of the plurality of frequency bands, based at least in part, on the feedback risk control value. Various examples are set forth below.

In this implementation, block 425 involves producing headphone microphone output audio data by applying the headphone microphone audio gain to the headphone microphone input audio data in at least one of the plurality of frequency bands. Here, block 430 involves mixing the media output audio data and the headphone microphone output audio data to produce mixed audio data. According to this implementation, block 435 involves providing the mixed audio data to the headphone speaker system. Blocks 425, 430 and 435 may be performed by a control system.

In some examples, block 420 may involve determining the feedback risk control value for at least a frequency band that includes a known environmental overlay instability frequency, e.g., an environmental overlay instability frequency that is known to be associated with a particular headphone implementation. Such a frequency band may be referred to herein as a "feedback frequency band." According to some such examples, determining the feedback risk control value may involve detecting an increase in amplitude in a feedback frequency band. The increase in amplitude may, for example, be greater than or equal to a feedback risk threshold. In some examples, determining the feedback risk control value may involve detecting the increase in amplitude within a feedback risk time window.

According to some implementations, determining the feedback risk control value may involve receiving a headphone removal indication and determining a headphone removal risk value based at least in part on the headphone removal indication. The headphone removal risk value may correspond with a risk that a set of headphones that includes the headphone speaker system and the headphone microphone system is, or will soon be, at least partially removed from a user's head.

In some implementations wherein the apparatus 300 includes the above-referenced sensor system 330, the headphone removal indication may be based, at least in part, on input from the sensor system 330. For example, the headphone removal indication may be based, at least in part, on inertial sensor data indicating headphone acceleration, inertial sensor data indicating headphone position change, touch sensor data indicating contact with the headphones and/or proximity sensor data indicating possible imminent contact with the headphones.

According to some examples, the headphone removal indication may be based, at least in part, on user input data corresponding with removal of the headphones. For example, at least one headphone unit may include a user interface (e.g., a touch or gesture sensor system, a button, etc.) with which a user may interact when the user is about to remove the headphones.

In some implementations, the headphone removal indication may be based, at least in part, on input from one or more headphone microphones. For example, when a user removes the headphones, the audio reproduced by a speaker of a left headphone unit may be detected by a microphone of a right headphone unit. Alternatively, or additionally, the audio reproduced by a speaker of a right headphone unit may be detected by a microphone of a left headphone unit. The microphone may be an interior or an exterior microphone. A headphone control system may determine that the audio data from a speaker of a headphone unit corresponds, at least in part, with the microphone data from the other headphone unit. According to some such implementations, the headphone removal indication may be based, at least in part, on left exterior headphone microphone data corresponding with audio reproduced by a left headphone speaker, right exterior headphone microphone data corresponding with audio reproduced by a right headphone speaker, left interior headphone microphone data corresponding with audio reproduced by a right headphone speaker and/or right interior headphone microphone data corresponding with audio reproduced by a left headphone speaker.

In some examples, determining the feedback risk control value may involve receiving an improper headphone positioning indication. Some such examples may involve determining an improper headphone positioning risk value based, at least in part, on the improper headphone positioning indication. The improper headphone positioning risk value may correspond with a risk that a set of headphones that includes the headphone speaker system and the headphone microphone system is positioned improperly on a user's head.

According to some examples, the improper headphone positioning indication may be based on input from a sensor system, e.g., input from an accelerometer or a gyroscope indicating that the position of one or more headphone units has changed. In some such examples, the improper headphone positioning risk value may correspond with the magnitude of change (e.g., the magnitude of acceleration) indicated by sensor data.

Alternatively, or additionally, the improper headphone positioning indication may be based, at least in part, on left exterior headphone microphone data corresponding with audio reproduced by a left headphone speaker, right exterior headphone microphone data corresponding with audio reproduced by a right headphone speaker, left interior headphone microphone data corresponding with audio reproduced by a right headphone speaker and/or right interior headphone microphone data corresponding with audio reproduced by a left headphone speaker.

Figure 5A:
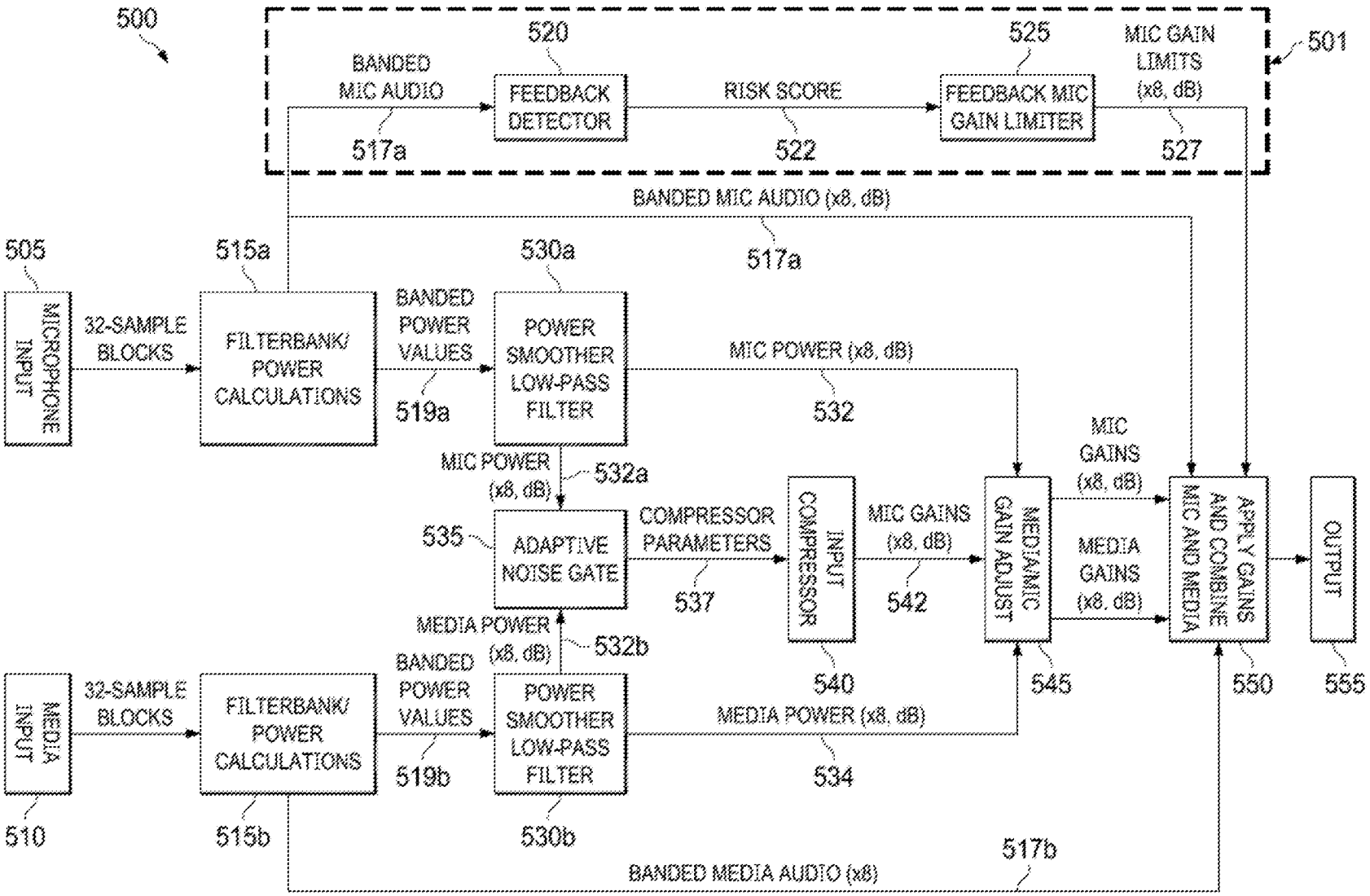
FIG. 5A is a block diagram that includes blocks of an MCP process according to some examples.

FIG. 5A is a block diagram that includes blocks of a media-compensated pass-through (MCP) process according to some examples. FIG. 6 is a block diagram that provides a detailed example of the feedback risk detector block 520 of FIG. 5A. As with other diagrams disclosed herein, the details shown in FIGS. 5 and 6, including but not limited to the values shown, the numbers and types of blocks, etc., are merely examples. In some implementations, the blocks of FIGS. 5 and 6 may be implemented by a control system, e.g., by the control system 310 of FIG. 3. Alternatively, or additionally, at least some blocks of FIGS. 5 and 6 may be implemented via software stored on one or more non-transitory media. The software may include instructions for controlling one or more devices to perform the described functions of these blocks.

In the example shown in FIG. 5A, the MCP system 500 is configured to determine levels for output signals that correspond to the environmental microphone signals 505 and the media input signals 510, mix these signals and provide output signals. According to this example, the gain applied to the environmental microphone signals may be controlled according to input from the feedback risk detector block 520. According to some implementations, except for the elements within the rectangle 501, the MCP system 500 may function as disclosed in International Publication No. WO 2017/217621, entitled "Media-Compensated Pass-Through and Mode-Switching," the relevant methods of which are incorporated by reference. However, other implementations may apply the feedback risk detection and mitigation techniques described herein to other MCP methodologies.

In this example, the environmental microphone signals 505 are provided to filterbank/power calculation block 515*a* and media input signals 510 are provided to filterbank/power calculation block 515*b*. The media input signals 510 may, for example, be received from a smart phone, from a television or another device of a home entertainment system, etc. In this example, the environmental microphone signals 505 are received from one or more environmental microphones of a headphone. The environmental microphone signals 505 and the media input signals 510 are provided to the filterbank/power calculation blocks 515*a* and 515*b* in 32-sample blocks in this example, but in other examples the environmental microphone signals 505 and the media input signals 510 may be provided via blocks having different numbers of samples.

The filterbank/power calculation blocks 515*a* and 515*b* are configured to transform input audio data in the time domain to banded audio data in the frequency domain. In this example, the filterbank/power calculation blocks 515*a* and 515*b* are configured to output frequency-domain audio data in eight frequency bands, but in other implementations the filterbank/power calculation blocks 515*a* and 515*b* may be configured to output frequency-domain audio data in more or fewer frequency bands. According to some examples, each of the filterbank/power calculation blocks 515*a* and 515*b* may be implemented as a fourth-order low-pass filter, a fourth-order high-pass filter and 6 eighth-order band-pass filters, implemented via 28 second-order-sections. Some such examples are implemented according to the filterbank design technique described in A. Favrot and C. Faller, "Complementary N-Band IIR Filterbank Based on 2-Band Complementary Filters," $12^{th}$ International Workshop on Acoustic Signal Enhancement (Tel-Aviv-Jaffa 2010), which is hereby incorporated by reference.

According to this example, the filterbank/power calculation block 515*a* outputs banded frequency-domain microphone audio data 517*a* to the feedback risk detector block 520 and the mixer block 550. The feedback risk detector block 520 may be configured to determine a feedback risk control value, e.g., as described above with reference to FIG. 4.

Here, the filterbank/power calculation block 515*a* outputs banded microphone power data 519*a*, indicating the power in each of the frequency bands of the banded frequency-domain microphone audio data 517*a*, to the smoother/low-pass filter block 530*a*. The smoother/low-pass filter block 530*a* outputs smoothed/low-pass filtered microphone power data 532, 532*a* to the adaptive noise gate block 535.

In this example, the filterbank/power calculation block 515*b* outputs banded frequency-domain media audio data 517*b* to the mixer block 550 and outputs banded media power data 519*b*, indicating the power in each of the frequency bands of the banded frequency-domain media audio data 517*b*, to the smoother/low-pass filter block 530*b*. The smoother/low-pass filter block 530*b* outputs smoothed/ low-pass filtered media power data 534, 532*b* to the adaptive noise gate block 535 and to the media ducking/microphone gain adjustment block 545.

According to this example, the adaptive noise gate block 535 is configured to determine whether the microphone signal corresponds with sounds that may be of interest to a user, such as a human voice, which should be boosted in level relative to the media or something uninteresting, such as background noise, which should not be boosted. In some implementations, the adaptive noise gate block 535 may apply microphone signal processing and/or mode-switching methods such as those disclosed in International Publication No. WO 2017/217621, entitled "Media-Compensated Pass-Through and Mode-Switching," the relevant methods of which are incorporated by reference.

In some examples, the adaptive noise gate block 535 may be configured to differentiate between background noise signals and non-noise signals. This is significant for MCP headphones because if background noise were processed in the same way that microphone signals of potential interest were processed, then the MCP headphones would boost the background noise signals to a level above that of the media signals. This would be a very undesirable effect.

According to some implementations, the filterbank/power calculation block 515*a* implement a multi-band algorithm. The filterbank/power calculation block 515*a* may, in some examples, operate independently on each of the frequency bands produced by the filterbank/power calculation block 515*a*. In some such implementations, the adaptive noise gate block 535 may produce two output values (537) for each frequency band, which may describe an estimate of the noise envelope. The two output values (537) for each frequency band may be referred to herein as "noise gate start" and "noise gate stop," as described in more detail below. In such implementations, microphone input signals having levels that rise above noise gate stop in a given band may be treated as not being noise (in other words, as being interesting signals that should be boosted above the media signal level).

In some examples, a "crest factor" is an important input to the adaptive noise gate block 535. The crest factor is derived from the microphone signal. According to some examples, when the crest factor is low the microphone signal is considered to be noise. In some such implementations, when a high crest factor is detected in a microphone signal, that microphone signal is considered to be of interest.

According to some implementations, the crest factor for each band may be calculated as the difference between a smoothed output power over a relatively shorter time interval (e.g., 20 ms) from the filterbank/power calculation block 515*a* and a smoothed version of the same output power over a relatively longer time interval (e.g., 2 seconds). These time intervals are merely examples. Other implementations may use shorter or longer time intervals for calculating the smoothed output powers and/or the crest factor. In some such examples, the calculated crest factors for each band are then regularized for the upper 4 bands. If any of these upper 4 band crest factors are positive and if the previous band has a lower crest factor, the previous band's crest factor is used instead. This technique prevents swishing sounds, which have increasing crest factors in higher frequencies, from "popping out" of the noise gate.

In some examples, the adaptive noise gate block 535 may be configured to "follow" the noise. According to some such examples, the adaptive noise gate block 535 may have two operational modes, which may be driven by the calculated crest factor of the microphone signal. In some such examples, a first operational mode may be invoked when the crest factor is below a specified threshold. In such situations, the microphone signal may be considered to be primarily noise. According to some examples of the first operational mode, the bottom of the noise gate ("noise gate start") is set to be just below the minimum microphone level. The top of the noise gate ("noise gate stop") may, for example, be set to halfway between the average media level and the bottom of the noise gate. This prevents small deviations in noise from popping out of the noise gate.

According to some such examples, a second operational mode may be invoked when the crest factor is above a specified threshold. Under such circumstances, the microphone signal may, in some examples, be considered interesting (e.g. primarily not background noise). In some such examples, a "minimum-follower" may prevent the bottom of the noise gate from tracking the signal during interesting portions. According to some such implementations, the top of the noise gate may be set to halfway between a slow-moving average microphone level and the bottom noise gate. Peaks may be boosted accordingly. Such implementations may allow relatively louder sounds through the gate in low-SNR background situations (for example, a loud café). Such implementations may also provide smooth transitions when media levels are only somewhat (e.g., 8 to 10 db) louder than background. According to some such implementations, in all other situations the top of noise gate will snap down to a much lower level when a high crest factor is detected.

Accordingly, the adaptive noise gate block 535 may output compressor parameters 537 that correspond with the determinations regarding whether the microphone signal corresponds with sounds that may be of interest. The output parameters 537 may, for example be per-band values based on the top and bottom of the noise gate, e.g., as previously described. In the example shown in FIG. 5A, the output parameters 537 are passed to the input compressor block 540.

According to the example shown in FIG. 5A, the input compressor block 540 determines microphone gains 542 and outputs the microphone gains 542 to the media and microphone gain adjustment block 545. In some such examples, the input compressor block 540 operates on per-band signals. According to some such examples, the input compressor block 540 creates a dynamic compression transfer function based on noise gate values and the media level. This compression transfer function may be applied to the input microphone signal.

Figure 5B:
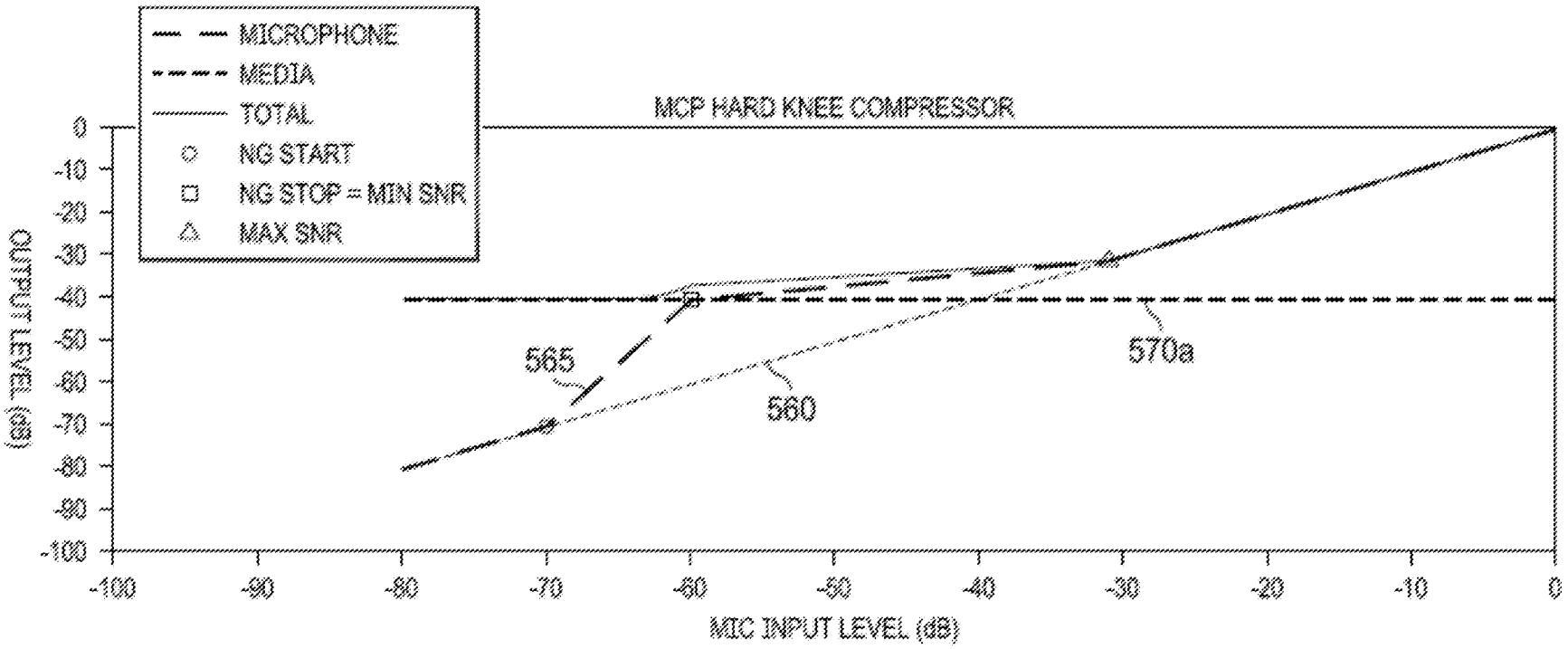
FIG. 5B shows an example of a transfer function that may be created by the input compressor block of FIG. 5A.
Figure 6:
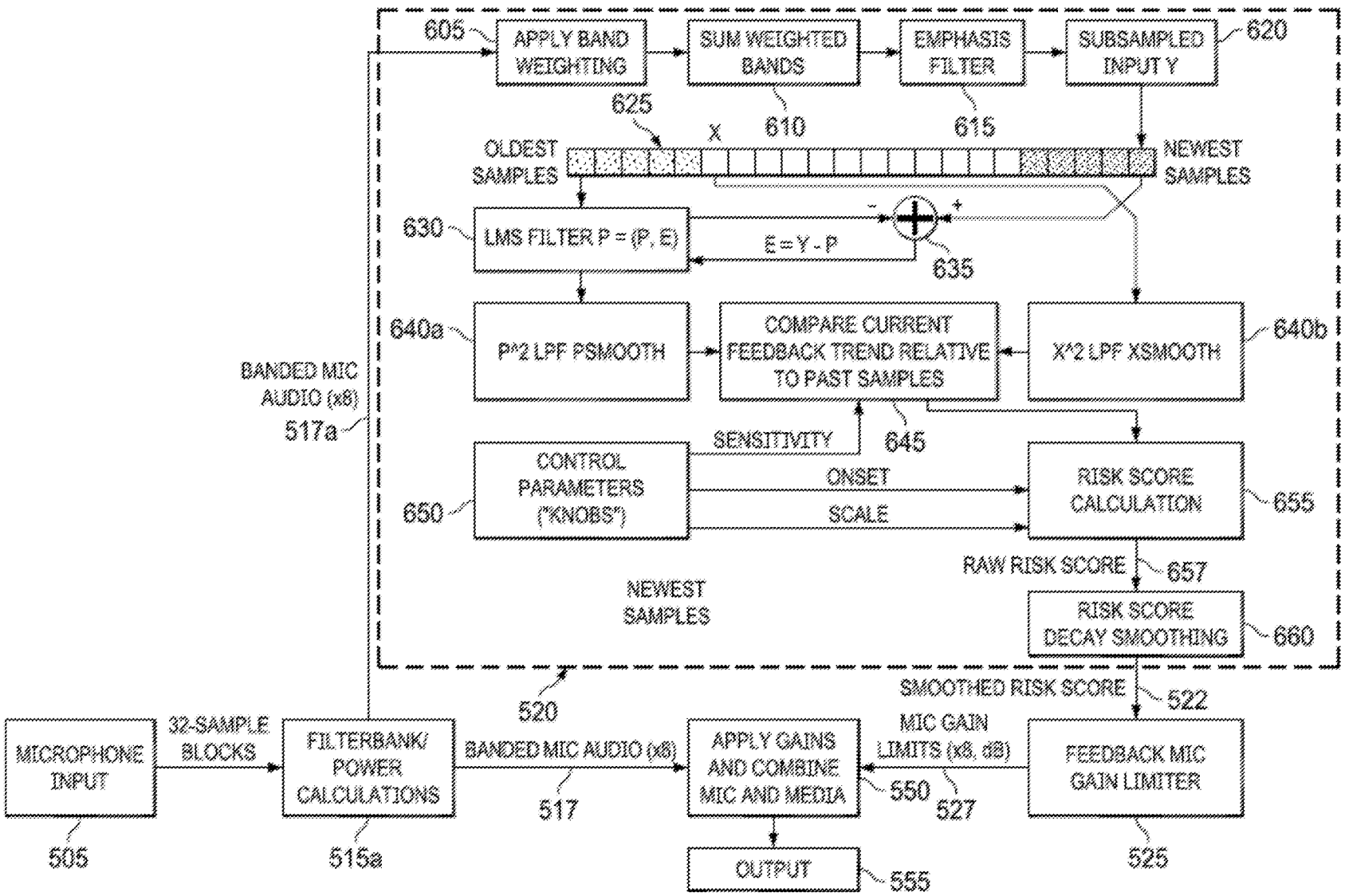
FIG. 6 is a block diagram that provides a detailed example of the feedback risk detector block of FIG. 5A.

FIG. 5B shows an example of a transfer function that may be created by the input compressor block of FIG. 5A. In this example, the microphone levels are boosted if the input microphone level is at or above the "noise gate start" level, which is −70 dB in this example. The degree to which the microphone levels are boosted are indicated by the vertical separation of between the input microphone level 560 and the output microphone level 565. In this example, the input microphone level is boosted relatively less between the "noise gate stop" level and the maximum signal-to-noise ratio (SNR) level, at or above which the input microphone level is not boosted. In some such implementations, the resulting per-band gains may then be weighted according to the energy level of nearby bands, to prevent individual bands from behaving spuriously. These gains 542 are passed to the media and microphone gain adjustment block 545.

The media and microphone gain adjustment block 545 determines gain values for the media and environmental microphone audio data that will be output to the mixer block 550. For example, some methods may involve adjusting levels such that the difference between a perceived loudness of the microphone input audio data and a perceived loudness of the microphone output audio data in the presence of the media output audio data is less than the difference between the perceived loudness of the microphone input audio data and a perceived loudness of the microphone input audio data in the presence of the media input audio data. In some implementations, the adjusting may involve only boosting the levels of one or more of the plurality of frequency bands of the microphone input audio data. However, in some examples the adjusting may involve both boosting the levels of one or more of the plurality of frequency bands of the microphone input audio data and attenuating the levels of one or more of the plurality of frequency bands of the media input audio data. The perceived loudness of the microphone output audio data in the presence of the media output audio data may, in some examples, be substantially equal to the perceived loudness of the microphone input audio data. According to some examples, the total loudness of the media and microphone output audio data may be in a range between the total loudness of the media and microphone input audio data and the total loudness of the media and microphone output audio data. However, in some instances, the total loudness of the media and microphone output audio data may be substantially equal to the total loudness of the media and microphone input audio data, or may be substantially equal to the total loudness of the media and microphone output audio data.

In some examples, the media and microphone gain adjustment block 545 may implement a media ducker or attenuator. According to some such examples, the media and microphone gain adjustment block 545 may be configured to determine the energy level of the input mix necessary to ensure that the compressed microphone signal plus the media signal does not sound louder than the media signal alone. The media ducker may operate on individual filter bank signals.

According to one such example, if the total input_energy is input_energy=|mic_in|+|media_in|, and the energy level after the mic has been boosted is output_energy=|mic_out|+|media_in|, the media and microphone gain adjustment block 545 may be configured to use a ratio of the input and output energy to compute a ducking gain which is applied to the mixed output, e.g., as follows:

mix_out=(mic_out+media_in)*input_energy/output_energy

According to some examples, the media and microphone gain adjustment block 545 may be configured to apply the ducking gain on a per-band basis.

Figure 5C:
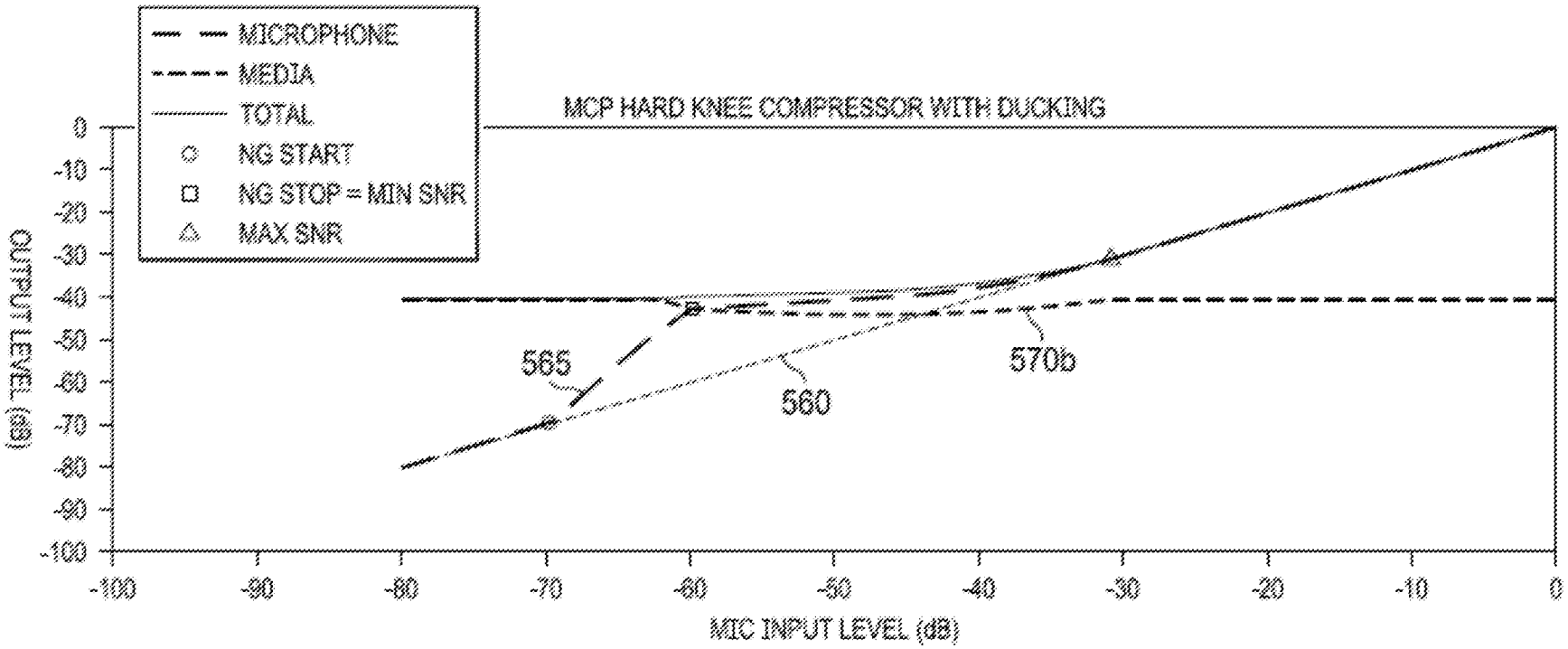
FIG. 5C shows an example of a ducking gain that may be applied by the media and microphone gain adjustment block of FIG. 5A.

FIG. 5C shows an example of a ducking gain that may be applied by the media and microphone gain adjustment block of FIG. 5A. The media levels 570*b* shown in FIG. 5C indicate the effect of the ducking gain. By comparing the media levels 570*a* shown in FIG. 5B with the media levels 570*b* shown in FIG. 5C, one may see the amount of media ducking that has been applied in this example.

According to this example, the mixer block 550 will apply the microphone and media gains received from the media and microphone gain adjustment block 545 to the banded frequency-domain microphone audio data 517*a* and the banded frequency-domain media audio data 517*b* to produce an output signal 555, subject to input (e.g., the microphone gain limits 527) that the mixer block 550 may receive from the feedback microphone gain limiter block 525.

In some examples, the microphone gain limits 527 may be based on a feedback risk control value 522 that the feedback microphone gain limiter block 525 receives from the feedback risk detector block 520. According to some implementations, the feedback microphone gain limiter block 525 may be configured for interpolating between a first set of gain values and a second set of gain values based, at least in part, on the feedback risk control value.

In some such implementations, the first set of gain values may be a set of minimum gain values for each frequency band of a plurality of frequency bands. In some examples, the second set of gain values may be a set of maximum gain values for each frequency band of the plurality of frequency bands. In some implementations, the environmental microphone signal gain will be set to the first set of gain values when an onset of feedback is detected. The maximum gain values may, for example, be a set of gain values that corresponds to a highest level of gain that can safely be applied to the environmental microphone signals without triggering feedback, based on empirical observations. According to some examples, the microphone gain limits 527 may be gradually "released" from the minimum gain values to the maximum gain values according to a feedback risk score decay smoothing process that will be described below.

FIG. 6 shows a detailed example of the feedback risk detector block 520. As noted above, some implementations of the feedback risk detector may include more or fewer blocks than are shown in FIG. 6. According to this example, the filterbank/power calculation block 515*a* outputs banded frequency-domain microphone audio data 517*a* to the band weighting block 605 of the feedback risk detector block 520.

In some instances, the band weighting block 605 may be configured to apply a weighting factor that is based upon prior knowledge of one or more environmental overlay instability frequencies. Weighting factors for each band may, for example, be chosen based on the observed environmental overlay instability of a headphone being tested. Weighting factors may be chosen to correlate with the observed levels of instability. The weighting factor may be designed to emphasize the microphone audio data in one or more frequency bands corresponding to the one or more environmental overlay instability frequencies, and/or to de-emphasize the microphone audio data in other frequency bands. In one simple example, the weighting factor may be a single value (e.g., 1) for frequency bands and zero for de-emphasized frequency bands. However, other types of weighting factors may be implemented in some examples. In some examples involving 8 frequency bands, the weights for each band may be [0.1, 0.3, 0.6, 0.8, 1.0, 0.9, 0.8, 0.5], [0.1, 0.2, 0.4, 0.7, 1.0, 0.9, 0.7, 0.4], [0.15, 0.35, 0.55, 0.85, 1.0, 1.0, 0.85, 0.55], [0.05, 0.15, 0.35, 0.65, 0.85, 0.9, 0.65, 0.4], [0.1, 0.2, 0.45, 0.7, 0.9, 0.9, 0.7, 0.45], [0.1, 0.35, 0.6, 0.8, 1.0, 0.8, 0.6, 0.35], [0.0, 0.25, 0.5, 0.75, 1.0, 1.0, 0.75, 0.5], [0.05, 0.3, 0.55, 0.8, 1.0, 1.0, 0.8, 0.55], [0.0, 0.20, 0.4, 0.65, 0.9, 1.0, 0.65, 0.4], [0.1, 0.3, 0.6, 0.85, 1.0, 1.0, 0.85, 0.6] or [0.1, 0.35, 0.6, 0.85, 1.0, 1.0, 0.85, 0.6].

In this example, the weighted bands are summed in the summation block 610 and the sum of the weighted bands is provided to the emphasis filter 615. The emphasis filter 615 may be configured to further isolate the frequency bands corresponding to the one or more environmental overlay instability frequencies. The emphasis filter 615 may be configured to emphasize one or more ranges of frequencies within the frequency band(s) corresponding to the one or more environmental overlay instability frequencies. The bandwidth(s) of the emphasis filter may be designed to contain the frequencies that cause instability and the magnitude of the emphasis filter may correspond to the relative level of the instabilities. According to some examples, emphasis filter bandwidths may be in the range of 100 Hz to 400 Hz. The emphasis filter 615 may be, or may include, a peaking filter. The peaking filter may have one or more peaks. Each of the peaks may be selected to target frequencies that cause instability. In some examples, a peaking filter may have target gain of 10 dB per peak. However, other examples may have a higher or lower target gain. According to some examples, the center frequencies of a peaking filter with multiple peaks may be close together, such that the filters overlap. In some such instances, the peak gain in some regions may exceed that of the target gain for a particular peak, e.g., may be greater than 10 dB. In some implementations, the feedback risk detector block 520 may include the band weighting block 605 or the emphasis filter 615, but not both.

In the implementation shown in FIG. 6, the feedback risk detector block 520 is configured for downsampling at least one of the plurality of frequency bands of the headphone microphone audio data, to produce downsampled headphone microphone audio data, and for storing the downsampled headphone microphone audio data in a buffer 625. In this example, the downsampling block 620 receives filtered headphone microphone audio data that is output from the emphasis filter 615 and downsamples the filtered headphone microphone audio data in order to reduce downstream processing complexity. In some implementations, the downsampling block 620 downsamples the filtered headphone microphone audio data by a factor of 4. In some such implementations, decimating by 4 means a factor of 16 lower MIPS downstream, because the number of samples has dropped by 4 and the number of taps in any filter has dropped by 4. Other implementations may involve decreased or increased amounts of downsampling.

In some implementations, the downsampling block 620 may downsample the filtered headphone microphone audio data without applying an anti-aliasing filter. Such implementations may provide computational efficiency, but can result in the loss of some frequency-specific information. In some such implementations, the feedback risk detector block 520 is configured for determining a risk of headphone feedback (which may be indicated by a feedback risk control value), but not for determining a particular frequency band that is causing the feedback risk. However, even if the system aliases the frequencies because no anti-aliasing filter is used, some implementations of the system could nonetheless be configured to look for effects at particular frequencies. If the system were looking for a tone that has been aliased to another frequency, the system may, for example, be configured to detect feedback risk in frequency ranges corresponding to the aliased frequency. For example, even if a particular ear device never experiences environmental overlay instability in frequency band 1, the system may be configured to look for environmental overlay instability in frequency band 1 regardless because a higher frequency may have aliased from band N (a higher-frequency band) down to band 1. According to the example shown in FIG. 6, the downsampled headphone microphone audio data from the downsampling block 620 are provided as the newest samples of the buffer 625.

In some implementations, the feedback risk detector block 520 is configured for applying a prediction filter to at least a portion of the downsampled headphone microphone audio data to produce predicted headphone microphone audio data. In some such examples, the feedback risk detector block 520 may be configured for retrieving downsampled headphone microphone audio data received at a time T from the buffer 625 and for applying the prediction filter to the downsampled headphone microphone audio data received at time T, to produce predicted headphone microphone audio data for a time T+N.

In some implementations, the feedback risk detector block 520 may be configured for retrieving actual downsampled headphone microphone audio data received at the time T+N from the buffer and for determining an error between the predicted headphone microphone audio data for the time T+N and the actual downsampled headphone microphone audio data received at the time T+N. In some such implementations, N may be less than or equal to 200 milliseconds.

In the example shown in FIG. 6, the prediction filter 630 is configured to operate on the oldest sample in the buffer 625. According to this implementation, the prediction filter 630 is a least mean squares (LMS) filter. The prediction filter 630 is configured to estimate a current signal based on the oldest sample in the buffer 625, which may have been received 100 milliseconds, 150 milliseconds, 200 milliseconds, etc., before the current signal in some examples.

In the example shown in FIG. 6, the prediction filter 630 is configured to make a prediction P of the current signal and to provide the signal to the error calculation block 635. In this example, the error calculation block 635 determines the error E by subtracting Y, the value of the newest sample in the buffer 625, from the prediction P. A large error E may be an indication of feedback risk. In some implementations, the error calculation block 635 may determine the error E by subtracting a value corresponding to a block of the newest samples in the buffer 625 from the prediction P (e.g., the newest 4 samples). According to this example, the prediction filter 630 determines the prediction P based not only on the oldest sample in the buffer, but also on the most recent error E received from the error calculation block 635.

According to some examples, the feedback risk detector block 520 may be configured for determining a current feedback risk trend based on multiple instances of predicted headphone microphone audio data and actual downsampled headphone microphone audio data. In some such examples, the feedback risk detector block 520 may be configured for determining a difference between the current feedback risk trend and a previous feedback risk trend. The feedback risk control value may be based, at least in part, on the difference. In some such examples, the feedback risk detector block 520 may be configured for smoothing the predicted headphone microphone audio data and the actual downsampled headphone microphone audio data before determining the difference.

In some implementations, the feedback risk detector block 520 may be configured for determining a predicted headphone microphone audio data power and an actual downsampled headphone microphone audio data power. The current feedback risk trend and the previous feedback risk trend may be based, at least in part, on the predicted headphone microphone audio data power and the actual downsampled headphone microphone audio data power. According to some such implementations, the feedback risk detector block 520 may be configured for determining a raw feedback risk score based, at least in part, on the difference and for applying a decay smoothing function to the raw feedback risk score to produce a smoothed feedback risk score. The feedback risk control value may be based, at least in part, on the smoothed feedback risk score.

In the example shown in FIG. 6, the prediction filter 630 outputs the amplitude of the predicted signal P to block 640*a*, which is configured to determine the power of the predicted signal P (also referred to herein as the "predicted headphone microphone audio data power") based on the amplitude of the predicted signal P. In this example, block 640*a* is also configured to apply a smoothing filter to the predicted headphone microphone audio data power to determine a smoothed predicted headphone microphone audio data power value, which block 640*a* provides to block 645. Applying the smoothing filter may, for example, involve using both a current power value of and recently-calculated power values of the predicted signal P, to determine the smoothed predicted headphone microphone audio data power value, e.g., by computing an average smoothed predicted headphone microphone audio data power value, which may or may not be a weighted average, depending on the particular implementation.

In the example shown in FIG. 6, block 640*b* is configured to determine the power of an actual downsampled headphone microphone audio signal X that is retrieved from the buffer 625. In some examples, the downsampled headphone microphone audio signal X may be the sample after the oldest sample in the buffer 625 (in other words, the sample that the buffer 625 received after the oldest sample). In some instances, the downsampled headphone microphone audio signal X may be the sample after a block of the oldest samples in the buffer 625 (e.g., after a block of the oldest 4 or 5 samples). According to this example, the block 640*b* is also configured to apply a smoothing filter to the power of an actual downsampled headphone microphone audio signal X, to determine a smoothed actual downsampled headphone microphone audio signal power value, which block 640*b* provides to block 645. Applying the smoothing filter may, for example, involve using both a current power value of and recently-calculated power values of actual downsampled headphone microphone audio signals X, to determine the smoothed actual downsampled headphone microphone audio signal power value, e.g., by computing an average downsampled headphone microphone audio signal power value, which may or may not be a weighted average, depending on the particular implementation.

Block 645 may be configured to compare a current actual feedback trend of the most recent samples in the buffer 625, relative to a predicted feedback trend based on the oldest samples in the buffer 625. According to this example, block 645 is configured to compare the input from block 640*a* with corresponding input from block 640*b*. In this implementation, by comparing smoothed predicted headphone microphone audio data power values with corresponding smoothed actual downsampled headphone microphone audio signal power values, block 645 is configured to compare a metric corresponding to the predicted feedback trend based on the most recent samples in the buffer 625, relative to a metric corresponding to current actual feedback trend of the most recent samples in the buffer 625. According to some examples, block 645 may be configured to calculate the (dB) level of the tonality of the microphone signal that is above the predicted value. When this calculated level is large enough (e.g., greater than an onset value referenced by the feedback risk score calculation block 655), the risk value rises above zero (see, e.g., Equation 2 below).

According to this example, the feedback risk score calculation block 655 determines a raw feedback risk score 657 based at least in part on input from block 645. According to some examples, the feedback risk score calculation block 655 determines the raw feedback risk score 657 based, at least in part, on one or more tunable parameters that may be provided by block 650. In the example shown in FIG. 6, the feedback risk score calculation block 655 determines the raw feedback risk score 657 based, at least in part, on tunable Sensitivity, Onset and Scale parameters that are provided via block 650.

In one example, the feedback risk score calculation block 655 determines the raw feedback risk score 657 by first determining a feedback value according to the following equation:

$$F=10\ \mathrm{Log}\ 10((P_{smooth})/(X_{smooth}+\mathrm{Sensitivity})) \qquad \text{(Equation 1)}$$

In Equation 1, F represents a feedback value, $P_{smooth}$ represents a smoothed predicted headphone microphone audio data power value (which may be determined by block 640*a*), $X_{smooth}$ represents a smoothed actual downsampled headphone microphone audio signal power value (which may be determined by block 640*b*) and Sensitivity represents a parameter that may be provided via block 650. In this example, Sensitivity is a threshold for feedback recognition which may, for example, be measured in decibels. The Sensitivity parameter may, for example, provide a lower limit/threshold on the level of the environmental input such that the calculated risk is zero for signals that are not loud enough to warrant a non-zero risk value. According to some examples, Sensitivity may be in the range of −40 dB to −80 dB, e.g., −55 dB, −60 dB or −65 dB. In some examples, relatively more negative values of F indicate relatively higher likelihood of feedback, whereas positive values indicate no feedback risk.

According to some such examples, the feedback risk score calculation block 655 determines the raw feedback risk score 657 that is based in part on the feedback value, e.g., according to the following equation:

$$\mathrm{Score}=\min(\max(F-\mathrm{Onset},0),\mathrm{Scale})/\mathrm{Scale} \qquad \text{(Equation 2)}$$

In Equation 2, Score represents the raw feedback risk score 657, and Onset and Scale represent parameters that may be provided via block 650. In this example, Onset represents a minimum (relative) level to trigger feedback detection and Scale represents a range of feedback levels above onset. In some examples, Onset may have a value in the range of −5 dB to −15 dB, e.g., −8 dB, −10 dB or −12 dB. According to some examples, Scale may map to a range of values, such as a range of values between 0.0 and 1.0. In some instances, Scale may have a value in the range of 2 dB to 6 dB, e.g., 3 dB, 4 dB or 5 dB.

In the example shown in FIG. 6, block 660 receives the raw feedback risk score 657 from the feedback risk score calculation block 655 and applies a smoothing function, to output a smoothed feedback risk score 522 to the feedback microphone gain limiter block 525. Block 660 may, for example, apply a low-pass filter to the raw feedback risk score 657. In some examples, the block 660 may apply a decay smoothing function to the raw feedback risk score 657, e.g., after a threshold level of feedback risk has been detected. The decay smoothing function may limit the gain of the environmental microphone signal, such that the environmental microphone signal does not increase too rapidly.

According to some implementations, the smoothed feedback risk score 522 may be used to interpolate between a minimum set of gain values and a maximum set of gain values for the environmental microphone signals. In some such implementations, the smoothed feedback risk score 522 may be used to linearly interpolate between the minimum set of gain values and the maximum set of gain values, whereas in other implementations the interpolation may be non-linear.

In some examples, block 550 may apply the decay smoothing function as follows:

$$\text{Smoothed Feedback Risk}=\max(0,\max((\text{Previous Feedback Risk Score}-\text{Feedback Risk Decay}),\ \text{Current Feedback Risk Score})) \quad \text{Equation 3}$$

In Equation 3, Feedback Risk Decay represents a decay coefficient for feedback risk score release. In some examples, Feedback Risk Decay may be in the range of 0.000005 to 0.00002, e.g., 0.00001. According to some examples, the decay smoothing may be made on a per-sample basis at a subsampled rate (e.g., after subsampling by 4). In one such example, so a decay coefficient of 0.00001 means the decay time to go from a maximum risk score (e.g., 1.0) to a minimum risk score (e.g., 0.0) would be (1/0.00001)/(Fs/4)=~8 seconds at Fs=48 kHz.

Various modifications to the implementations described in this disclosure may be readily apparent to those having ordinary skill in the art. The general principles defined herein may be applied to other implementations without departing from the scope of this disclosure. Thus, the claims are not intended to be limited to the implementations shown herein, but are to be accorded the widest scope consistent with this disclosure, the principles and the novel features disclosed herein.

The invention claimed is:

1. An audio device, comprising:

an interface system;

a microphone system that includes at least one microphone;

a speaker system that includes at least one speaker; and a control system configured for:

receiving, via the interface system, media input audio data corresponding to a media stream;

receiving, via the interface system, microphone input audio data from the microphone system;

determining a media audio gain for a plurality of frequency bands of the media input audio data;

determining a microphone audio gain for a plurality of frequency bands of the microphone input audio data;

producing media output audio data by applying the media audio gain to the media input audio data in the plurality of frequency bands of the media input audio data;

producing microphone output audio data by applying the microphone audio gain to the microphone input audio data in the plurality of frequency bands of the microphone input audio data;

mixing the media output audio data and the microphone output audio data to produce mixed audio data; and providing the mixed audio data to the speaker system;

wherein the control system is further configured for:

determining, for at least one frequency band of the microphone input audio data, a feedback risk control value corresponding to a risk of feedback between at least one microphone of the microphone system and at least one speaker of the speaker system; and determining the microphone audio gain for the at least one frequency band of the microphone input audio data based, at least in part, on the feedback risk control value;

wherein the control system is further configured for:

applying a prediction filter to at least a portion of microphone audio data received at a time T to produce predicted microphone audio data for a time T+N;

determining a current feedback risk trend based on multiple instances of predicted microphone audio data and actual microphone audio data;

determining a difference between the current feedback risk trend and a previous feedback risk trend; and determining the feedback risk control value based, at least in part, on the difference between the current feedback risk trend and the previous feedback risk trend.

2. The audio device of claim 1, wherein determining the feedback risk control value involves detecting an increase in amplitude of the microphone input audio data in the at least one frequency band, wherein the increase in amplitude is greater than or equal to a feedback risk threshold.

3. The audio device of claim 2, wherein determining the feedback risk control value involves detecting the increase in amplitude within a feedback risk time window.

4. The audio device of claim 1, wherein determining the feedback risk control value involves receiving an audio device removal indication and determining an audio device removal risk value based, at least in part, on the audio device removal indication, the audio device removal risk value corresponding with a risk that the audio device is, or will be, at least partially removed from a user's head.

5. The audio device of claim 4, wherein the audio device removal indication is based, at least in part, on one or more factors selected from a list of factors consisting of: inertial sensor data indicating acceleration of the audio device; inertial sensor data indicating position change of the audio device; touch sensor data indicating contact with the audio device; proximity sensor data indicating possible imminent contact with the audio device; and user input data corresponding with removal of the audio device.

6. The audio device of claim 4, wherein the audio device removal indication is based, at least in part, on one or more factors selected from a list of factors consisting of: microphone audio data from a left exterior microphone of the audio device, corresponding with audio reproduced by a left speaker of the audio device; microphone audio data from a right exterior microphone of the audio device, corresponding with audio reproduced by a right speaker of the audio device; microphone audio data from a left interior microphone of the audio device, corresponding with audio reproduced by a right speaker of the audio device; and microphone audio data from a right interior microphone of the audio device, corresponding with audio reproduced by a left speaker of the audio device.

7. The audio device of claim 1, wherein determining the feedback risk control value involves receiving an improper positioning indication and determining an improper positioning risk value based, at least in part, on the improper positioning indication, the improper positioning risk value corresponding with a risk that the audio device is positioned improperly on a user's head.

8. The audio device of claim 7, wherein the improper positioning indication is based, at least in part, on one or more factors selected from a list of factors consisting of: microphone audio data from a left exterior microphone of the audio device, corresponding with audio reproduced by a left speaker of the audio device; microphone audio data from a right exterior microphone of the audio device, corresponding with audio reproduced by a right speaker of the audio device; microphone audio data from a left interior microphone of the audio device, corresponding with audio reproduced by a right speaker of the audio device; and microphone audio data from a right interior microphone of the audio device, corresponding with audio reproduced by a left speaker of the audio device.

9. The audio device of claim 1, wherein the control system is further configured for:

determining a most recent error between the predicted microphone audio data for the time T+N and actual microphone audio data received at the time T+N; and determining the predicted microphone audio data for the time T+N based also on the most recent error.

10. The audio device of claim 1, wherein the control system is further configured for:

storing microphone audio data in a buffer; and retrieving the microphone audio data received at the time T and the microphone audio data received at the time T+N from the buffer.

11. The audio device of claim 10, wherein the control system is further configured for:

downsampling at least one of the plurality of frequency bands of the microphone audio data before storing the microphone audio data in the buffer.

12. The audio device of claim 11, wherein the control system is further configured for downsampling the at least one of the plurality of frequency bands of the microphone audio data without applying an anti-aliasing filter.

13. The audio device of claim 1, wherein N is less than or equal to 200 milliseconds.

14. The audio device of claim 1, wherein the control system is further configured for smoothing the predicted microphone audio data and the actual microphone audio data before determining the difference between the current feedback risk trend and the previous feedback risk trend.

15. The audio device of claim 1, wherein the control system is further configured for determining a power of the predicted microphone audio data and a power of the actual microphone audio data, and for determining the current feedback risk trend and the previous feedback risk trend based, at least in part, on the determined power of the predicted microphone audio data and the determined power of the actual microphone audio data.

16. The audio device of claim 1, wherein the control system is further configured for determining a raw feedback risk score based, at least in part, on the difference between the current feedback risk trend and the previous feedback risk trend; for applying a decay smoothing function to the raw feedback risk score to produce a smoothed feedback risk score; and for determining the feedback risk control value based, at least in part, on the smoothed feedback risk score.

17. The audio device of claim 10, wherein the control system is further configured for, before storing the microphone audio data in the buffer:

applying a weighting factor to one or more frequency bands of the microphone audio data; and summing the one or more frequency bands of microphone audio data after applying the weighting factor.

18. The audio device of claim 17, wherein the weighting factor is one for some frequency bands, and zero for other frequency bands.

19. The audio device of claim 10, wherein the control system is further configured for, before storing the microphone audio data in the buffer, applying an emphasis filter to the microphone audio data, wherein the emphasis filter is configured to emphasize one or more ranges of frequencies within one or more frequency bands.

20. The audio device of claim 1, wherein determining the microphone audio gain involves interpolating between a first set of gain values and a second set of gain values and wherein the interpolation is based, at least in part, on the feedback risk control value, wherein the first set of gain values comprises a minimum gain value for each frequency band of the plurality of frequency bands of the microphone input audio data and wherein the second set of gain values comprises a maximum gain value for each frequency band of the plurality of frequency bands of the microphone input audio data.

21. The audio device of claim 1, the audio device comprising headphones or earbuds.

22. An audio processing method, comprising:

receiving, via an interface system, media input audio data corresponding to a media stream;

receiving, via the interface system, microphone input audio data from a microphone system;

determining, via a control system, a media audio gain for a plurality of frequency bands of the media input audio data;

determining, via the control system, a microphone audio gain for a plurality of frequency bands of the microphone input audio data;

producing, via the control system, media output audio data by applying the media audio gain to the media input audio data in the plurality of frequency bands of the media input audio data;

producing, via the control system, microphone output audio data by applying the microphone audio gain to the microphone input audio data in the plurality of frequency bands of the microphone input audio data;

mixing, via the control system, the media output audio data and the microphone output audio data to produce mixed audio data; and providing the mixed audio data to the speaker system;

the audio processing method further comprising:

determining, via the control system, for at least one frequency band of the microphone input audio data, a feedback risk control value corresponding to a risk of feedback between at least one microphone of the microphone system and at least one speaker of the speaker system; and determining, via the control system, the microphone audio gain for the at least one frequency band of the microphone input audio data based, at least in part, on the feedback risk control value;

applying a prediction filter to at least a portion of microphone audio data received at a time T to produce predicted microphone audio data for a time T+N;

determining a current feedback risk trend based on multiple instances of predicted microphone audio data and actual microphone audio data;

determining a difference between the current feedback risk trend and a previous feedback risk trend; and determining the feedback risk control value based, at least in part, on the difference between the current feedback risk trend and the previous feedback risk trend.

23. The audio processing method of claim 22, wherein determining the feedback risk control value involves detecting an increase in amplitude of the microphone input audio data in the at least one frequency band, wherein the increase in amplitude is greater than or equal to a feedback risk threshold.

24. The audio processing method of claim 23, wherein determining the feedback risk control value involves detecting the increase in amplitude within a feedback risk time window.

25. One or more non-transitory media having software stored thereon, the software including instructions for controlling one or more devices to perform an audio processing method according to claim 22.

* * * * *